US007234919B2

(12) United States Patent
Lee et al.

(10) Patent No.: US 7,234,919 B2
(45) Date of Patent: Jun. 26, 2007

(54) HEAT-DISSIPATING FAN

(75) Inventors: Chin-Hung Lee, Taoyuan (TW); Shun-Chen Chang, Taoyuan (TW); Kuo-Cheng Lin, Taoyuan (TW); Wen-Shi Huang, Taoyuan (TW); Hsiou-Chen Chang, Taoyuan (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 166 days.

(21) Appl. No.: 11/002,099

(22) Filed: Dec. 3, 2004

(65) Prior Publication Data

US 2006/0042894 A1 Mar. 2, 2006

(30) Foreign Application Priority Data

Aug. 27, 2004 (TW) ..... 93125861 A

(51) Int. Cl.
*F01D 1/04* (2006.01)
*F01D 9/02* (2006.01)

(52) U.S. Cl. ..... 415/208.2; 415/211.2

(58) Field of Classification Search ..... 415/178, 415/208.2, 211.2, 213.1, 220, 211.1; 416/223 R, 416/235

See application file for complete search history.

(56) References Cited

U.S. PATENT DOCUMENTS 3,727,593 A * 4/1973 Enke ..... 415/218.1
5,484,013 A * 1/1996 Morikawa et al. ..... 165/80.3
5,559,674 A * 9/1996 Katsui ..... 361/697
5,707,205 A * 1/1998 Otsuka ..... 415/119
5,940,268 A * 8/1999 Miyahara et al. ..... 361/697
6,045,327 A * 4/2000 Amr ..... 415/211.2
6,132,170 A * 10/2000 Horng ..... 415/178
6,544,010 B1 * 4/2003 Choi ..... 416/223 R
6,547,540 B1 * 4/2003 Horng et al. ..... 415/211.2

FOREIGN PATENT DOCUMENTS

JP 2004132300 A * 4/2004

* cited by examiner

*Primary Examiner*—Igor Kershteyn
(74) *Attorney, Agent, or Firm*—Birch, Stewart, Kolasch & Birch, LLP

(57) ABSTRACT

A heat-dissipating fan with a plurality of upward rotor blades is provided. The heat-dissipating fan includes a housing, an impeller having a hub and a plurality of rotor blades disposed around the hub, and a base disposed inside the housing for supporting the impeller thereon. The rotor blades have at least one inclined edge with a first inclined angle relative to the horizontal line perpendicular to the axis of the heat-dissipating fan, respectively.

36 Claims, 9 Drawing Sheets

HEAT-DISSIPATING FAN

FIELD OF THE INVENTION

The present invention is related to a heat-dissipating fan, and especially to an axial-flow fan.

BACKGROUND OF THE INVENTION

In a normal electronic product such as a computer, electronic devices will generate a lot of heat during operation. If the electronic devices are continuously operated at high temperature, they are easily damaged. Thus, to prevent such a damage, a heat-dissipating fan is normally disposed in the electronic product to dissipate heat to the surrounding.

Please refer to FIG. 1 which shows a conventional axial-flow fan for the computer. The conventional axial-flow fan mainly includes a housing 10, a motor 11 and an impeller 12 with a plurality of rotor blades 121. The housing 10 includes a base 14 for supporting the motor 11 and has a plurality of ribs 13 at the air outlet side of the axial-flow fan. When the motor 11 drives the impeller 12 to rotate, the blades 121 will discharge the airflow from the air outlet side of the axial-flow fan. However, according to the commonly used design, the lower edge of each rotor blade 121 is shaped in a horizontal form and the flow rate of airflow is the fastest at the end of the rotor blade. More airflow will flow in or out especially near the end edge of rotor blades. Thus, as the airflow contact the ribs 13, it will cause the mixed airflow and generate a lot of noise. It is caused by that the distance H between the lower edge of the rotor blade 121 (in a horizontal form) and the rib 13 is relatively small such that it will generate a lot of noise in a very short time as the airflow passes therethrough, thereby worsening the sound.

Thus, it is desirable to reduce the noise of the axial-flow fan generated while rotating.

SUMMARY OF THE INVENTION

The present invention provides a heat-dissipating fan including a housing, an impeller having a hub and a plurality of rotor blades arranged around the hub, and a base disposed inside the housing for supporting the impeller, wherein at least one rotor blade has a first edge with a first inclined angle relative to a line perpendicular to an axis of the heat-dissipating fan.

Preferably, the first inclined angle is ranged from 3° to 45° and located near an air inlet side of the heat-dissipating fan.

In addition, the rotor blade has a second edge located opposite to the first edge and having a second inclined angle relative to the line, wherein the second edge is located near an air outlet side of the heat-dissipating fan and preferably ranged from 3° to 45°. The first inclined angle can be greater than, equal to or less than the second inclined angle.

Further, the heat-dissipating fan further includes an air-guiding member disposed between the housing and the base, and positioned on an air inlet or an air outlet of the heat-dissipating fan. The air-guiding member has an edge with a third inclined angle, relative to the line, located on a windward side of the heat-dissipating fan, wherein the third inclined angle is preferably ranged from 3° to 45°.

Additionally, the air-guiding member has an opposite edge with a fourth inclined angle relative to the line. The third inclined angle can be greater than, equal to or less than the fourth inclined angle. The fourth inclined angle is preferably ranged from 3° to 45°.

Preferably, the air-guiding member has one end connected to the base and the other end free extending toward a direction of an inner wall of the housing. Alternatively, the air-guiding member has one end connected to an inner wall of the housing and the other end free extending toward a direction of the base. Alternatively, the air-guiding member is composed of a plurality of ribs or stationary blades, some of which respectively have one end connected to the base and the other end free extending toward a direction of an inner wall of the housing, and others of which respectively have one end connected to an inner wall of the housing and the other end free extending toward a direction of the base.

Preferably, the air-guiding member has a gradually increasing or decreasing cross-section area from the base toward the housing, or has a central part with a thickness relatively greater or smaller than those of two opposite ends thereof.

Preferably, the air-guiding member is composed of a plurality of ribs or stationary blades, the number of which is unequal to that of the rotor blades. The air-guiding member has a stick, curved, trapezoid, or wing-like cross-section shape. The housing includes a cylindrical part and the air-guiding member has one end connected to the base and the other end connected to an inner wall of the cylindrical part.

The housing has an outwardly expanding part located on an air inlet side or an air outlet side of the heat-dissipating fan for increasing an air intake or discharge. The air-guiding member can have one end connected to the base and the other end connected to inner walls of the cylindrical part and the outwardly expanding part.

Preferable, the base, the air-guiding member and the housing are integrally formed as a monolith piece by injection molding. The rotor blades respectively have a curved or wing-like cross-section with an inclined angle ranging from 15° to 60° relative to the axis of the heat-dissipating fan.

Moreover, the heat-dissipating fan further includes a metallic shell telescoped inside the hub and having a plurality of openings and has a stepped structure formed on a periphery of a top portion of the metallic shell. The hub has a plurality of through holes formed on a top portion thereof such that the heat generated from the internal components inside the fan can be dissipated to outside via the openings of the metallic shell and the through holes of the hub.

The heat-dissipating fan further includes a driving device mounted inside the hub for driving the impeller.

The hub has an inclined or arc structure formed on a periphery of a top portion thereof, and a vertical portion. The rotor blades of the impeller respectively have an upper inner edge positioned at an interface between the inclined or arc structure and the vertical portion. The rotor blades of the impeller respectively have a lower inner edge relatively higher than a bottom end of the vertical portion.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

The present invention will now be described more detailedly with reference to the following embodiments. It is to be noted that the following descriptions of the preferred embodiments of this invention are presented herein for the purpose of illustration and description only. It is not intended to be exhaustive or to be limited to the precise form disclosed.

Figure 2A:
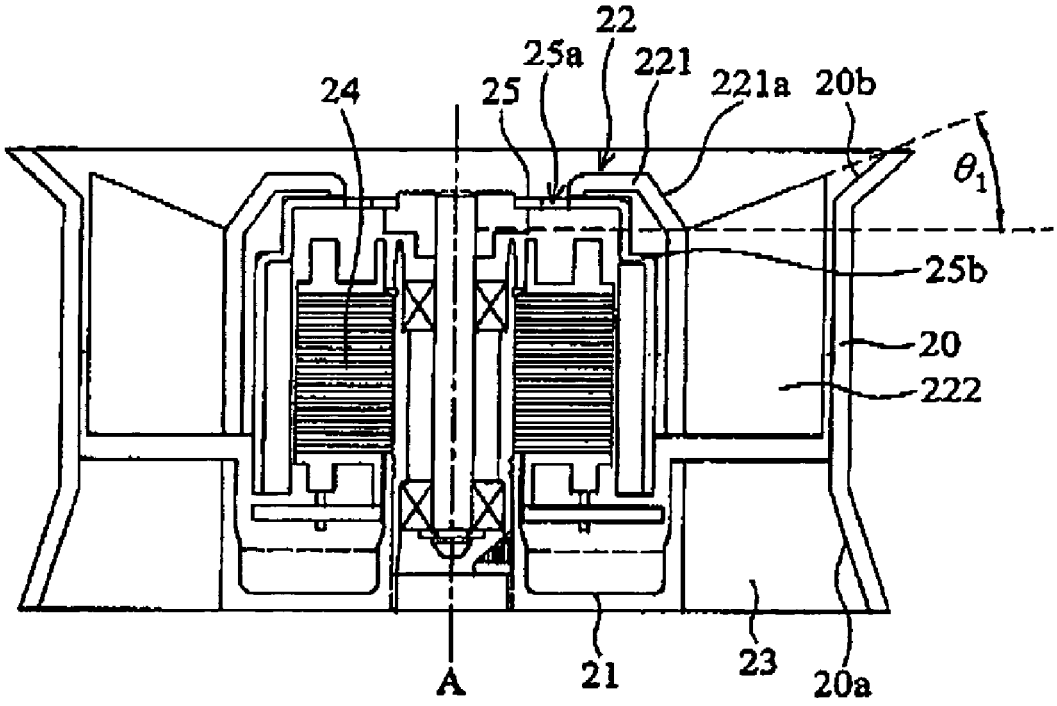
FIG. 2*a* is a sectional view of the first preferred embodiment of the heat-dissipating fan of the present invention.

First of all, please refer to FIG. 2*a* which shows the first preferred embodiment of the heat-dissipating fan of the present invention. The heat-dissipating fan includes a housing 20, a base 21 mounted inside the housing 20 for supporting a driving device or motor 24 used for driving the heat-dissipating fan to rotate, and an air-guiding member 23 disposed between the base 21 and the housing 20 and positioned at the air outlet side or the air inlet side of the heat-dissipating fan.

The heat-dissipating fan further includes an impeller 22 having a hub 221 and a plurality of rotor blades 222 arranged around the hub 221. The hub 221 has an inclined structure 221*a* located on a periphery of a top portion thereof for smoothly guiding more airflow toward the rotor blades 222. Except that the housing 20 can be shaped as a square structure as shown in FIG. 2, it can also be shaped as a rectangle or circular profile. The housing 20, the base 21 and the air-guiding member 23 can be integrally formed as a monolithic piece by injection molding, using a plastic, metal or other similar material.

The heat-dissipating fan further includes a metallic shell 25 telescoped inside the hub 221, which has a stepped structure 25*b* on its upper edge corresponding to the position of the inclined structure 221*a* of the hub. The driving device 24 can be mounted inside the hub and the metallic shell for reducing the occupied space. In addition, the metallic shell 25 has a plurality of openings 25*a* formed on a top thereof for effectively dissipating the heat generated inside the fan while operating.

The housing 20 has an outwardly expanding part 20*a* located at the air outlet side of the fan and another outwardly expanding part 20*b* located at the air inlet side of the fan for increasing the intake and discharge airflow and smoothly guiding the airflow toward the impeller.

Figure 2B:
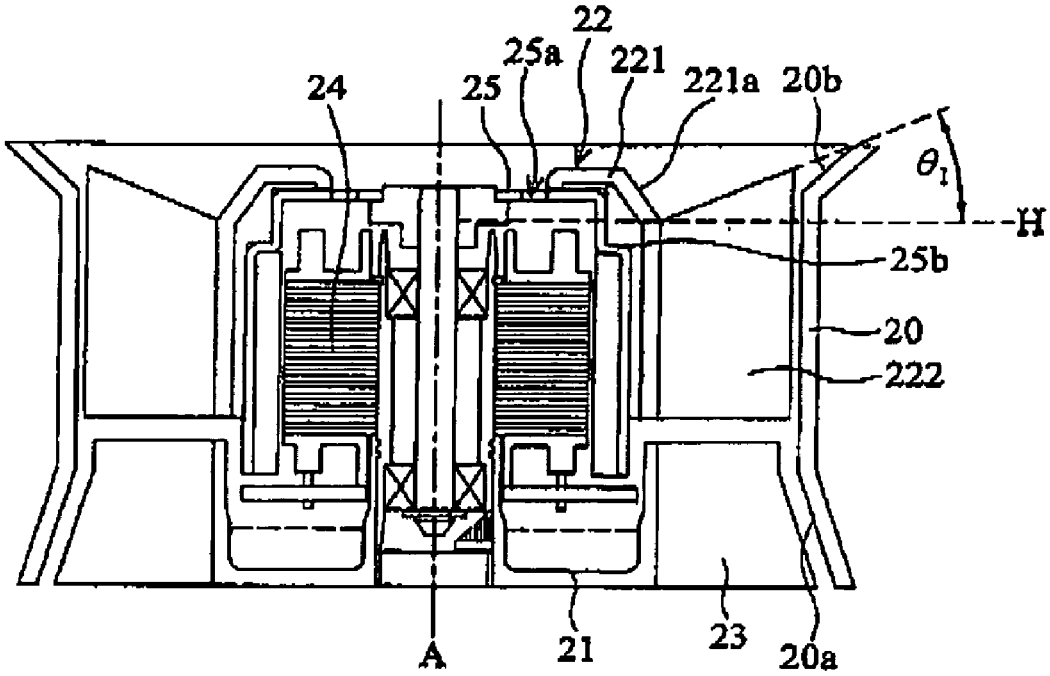
FIG. 2*b*, is a sectional view of another preferred embodiment of the heat-dissipating fan of the present invention.
Figure 2C:
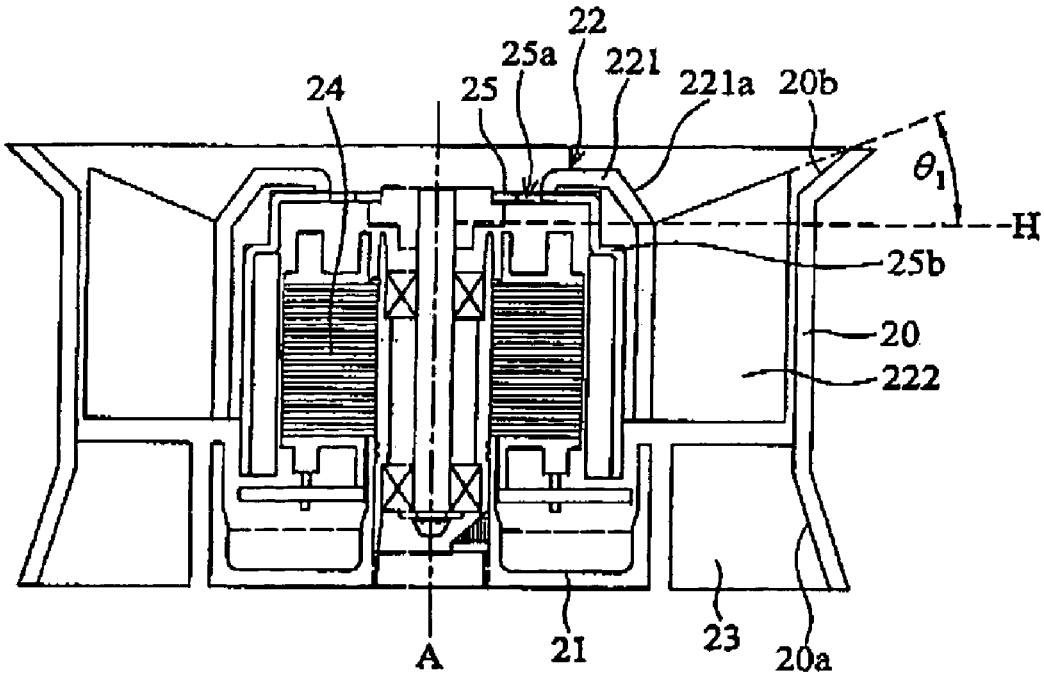
FIG. 2*c* is a sectional view of another preferred embodiment of the heat-dissipating fan of the present invention.
Figure 2D:
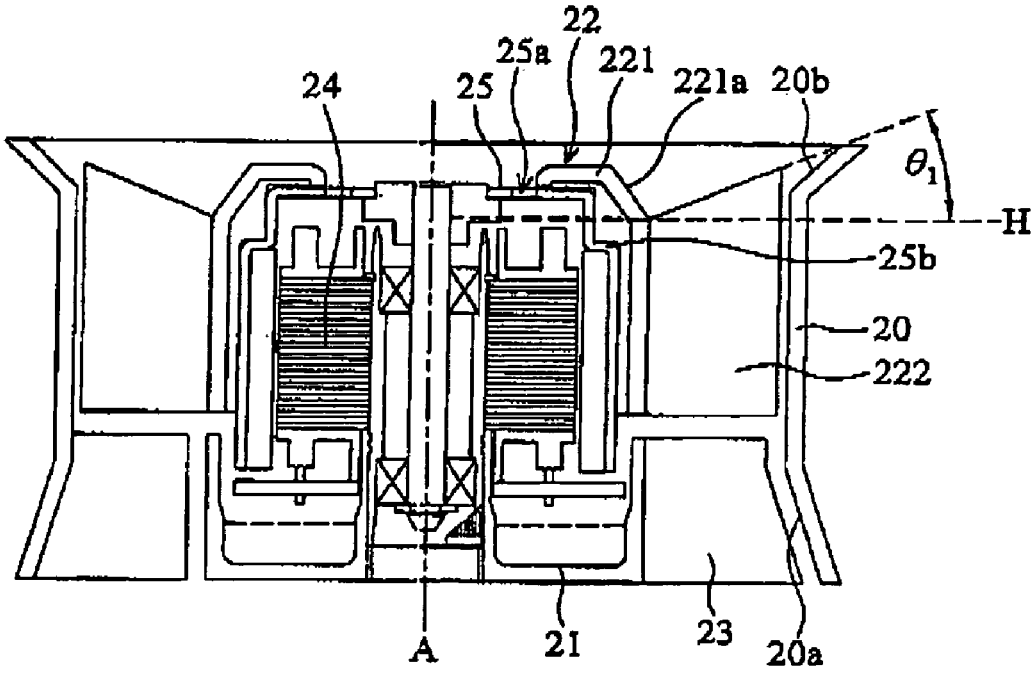
FIG. 2*d* is a sectional view of another preferred embodiment of the heat-dissipating fan of the present invention.

The air-guiding member 23 can be composed of a plurality of ribs or stationary blades connected between the outwardly expanding part 20*a* and the base 21. However, the arrangement of the air-guiding members 23 can be varied or modified according to the actual application. For example, one end of the air-guiding member 23 is connected to the base 21 and the other end thereof is free and extended toward the outwardly expanding part 20*a* as shown in FIG. 2*b*; alternatively, one end of the air-guiding member 23 is connected to the outwardly expanding part 20*a* and the other end thereof is free and extended toward the base 21 as shown in FIG. 2*c*; alternatively, some of ribs or stationary blades respectively have the ends connected to the base 21 and the opposite end thereof free extended toward a direction of the outwardly expanding part 20*a*, but others respectively have the ends connected to the outwardly expanding part 20*a* and the opposite end thereof free extended toward a direction of the base 21 as shown in FIG. 2*d*. In addition, the cross-section area of the air-guiding member 23 can be constant, or gradually increased or decreased in a direction from the base 21 toward the outwardly expanding part 20*a*. Alternatively, the air-guiding member 23 can be shaped as an inside recessing or outside jutting configuration, that is to say, the thickness of a central portion of the air guiding member 23 is relatively greater or smaller than those of two opposite ends thereof.

As shown in FIG. 2*a*, the upper edge of the rotor blade 222 near the air inlet side has an inclined angle $\theta_1$ relative to a horizontal line H perpendicular to an axis A of the fan. The inclined angle $\theta_1$ is preferably ranged from 3° to 45°. The position of an upper inner edge of the rotor blade is lower than the top surface of the hub 221, that is, both of them are not at the same plane, Because there is an inclined angle $\theta_1$ between the upper edge of the rotor blade and the horizontal line H, it can contribute to an increase in the working area close to the hub 221 and an even air distribution on the whole rotor blades, thereby preventing the airflow from being over accumulated on the upper edge of the rotor blades and eliminating the noise caused by the air turbulence.

Figure 3:
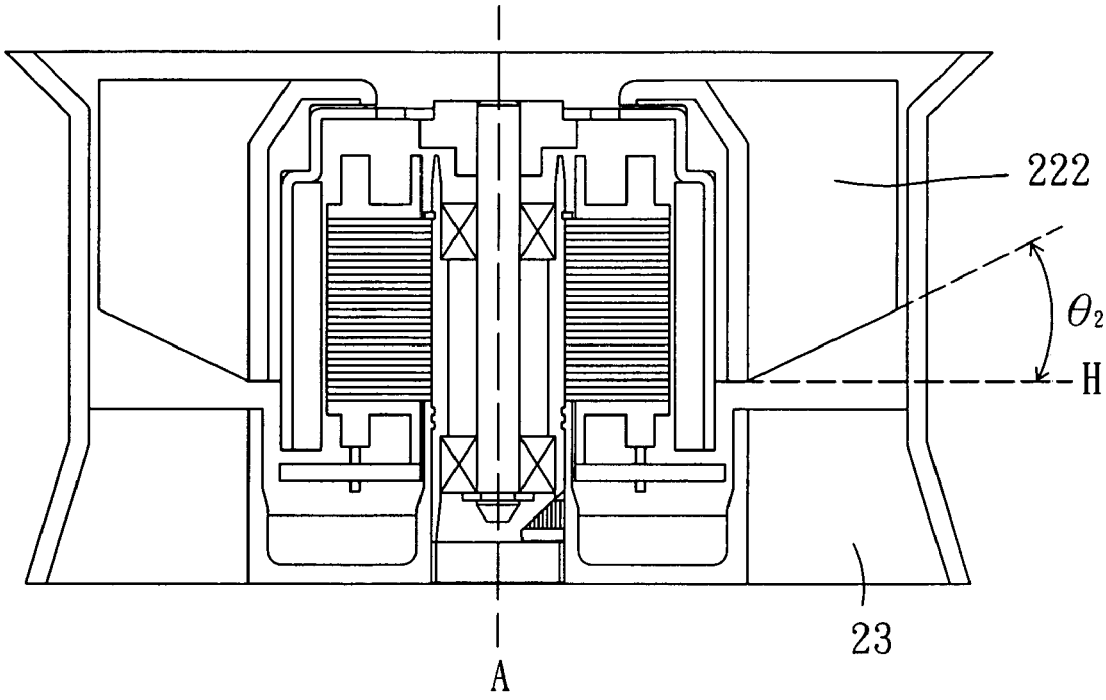
FIG. 3 is a sectional view of the second preferred embodiment of the heat-dissipating fan of the present invention.

Now, please refer to FIG. 3 showing the second preferred embodiment of the heat-dissipating fan of the present invention. Its structure is substantially similar to that of the first preferred embodiment except that the upper edge of the rotor blade 23 is positioned at the same plane as the top surface of the hub, that is, at the same height, and there is an inclined angle $\theta_2$ between a lower edge of the rotor blade near the air outlet side and the horizontal line H in this embodiment. The inclined angle $\theta_2$ is preferably ranged from 3° to 45°. Because the rotor blade has an upward lower edge, it can reduce the work of the rotor blades against the airflow at its bottom portion so as to increase its heat dissipating efficiency. Additionally, such a design can separate the arriving time of the airflow toward the air-guiding member 23, thereby eliminating the noise caused by the air turbulence.

Figure 4:
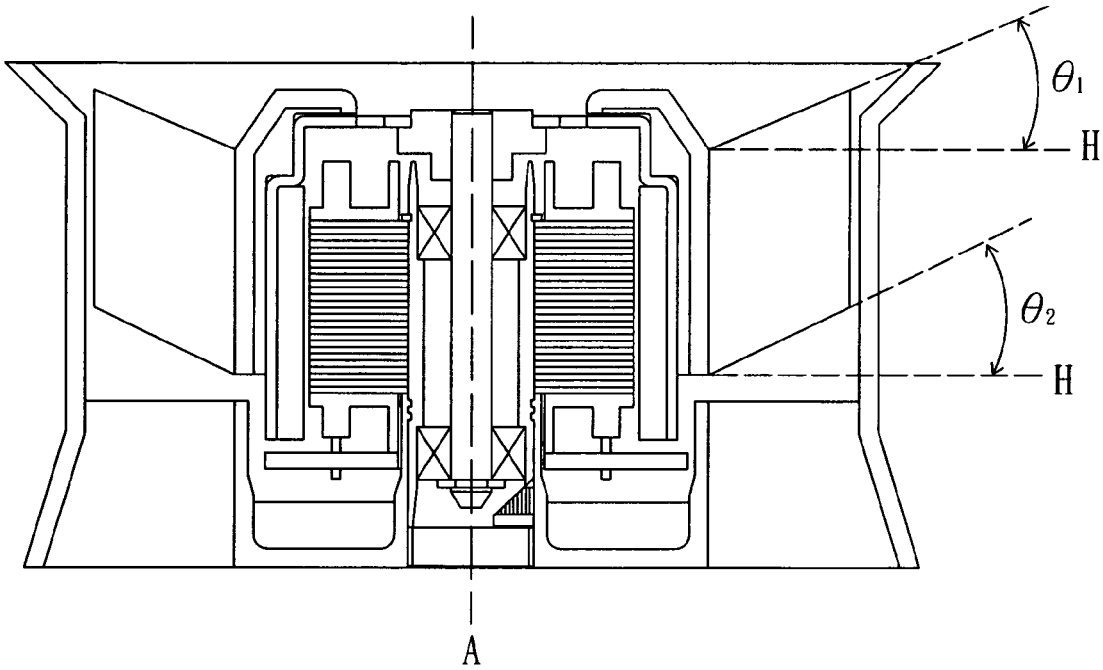
FIG. 4 is a sectional view of the third preferred embodiment of the heat-dissipating fan of the present invention.

Please refer to FIG. 4 showing the third preferred embodiment of the heat-dissipating fan of the present invention. Its structure is substantially similar to that of the first preferred embodiment. The difference is that there is an inclined angle $\theta_1$ between the upper edge of the rotor blade 222 (near the air inlet side) and the horizontal line H and there is also an inclined angle $\theta_2$ between its lower edge (near the air outlet side) and the horizontal line H in this embodiment. The inclined angle $\theta_1$ can be greater than, equal to, or smaller than the inclined angle $\theta_2$.

Figure 5A:
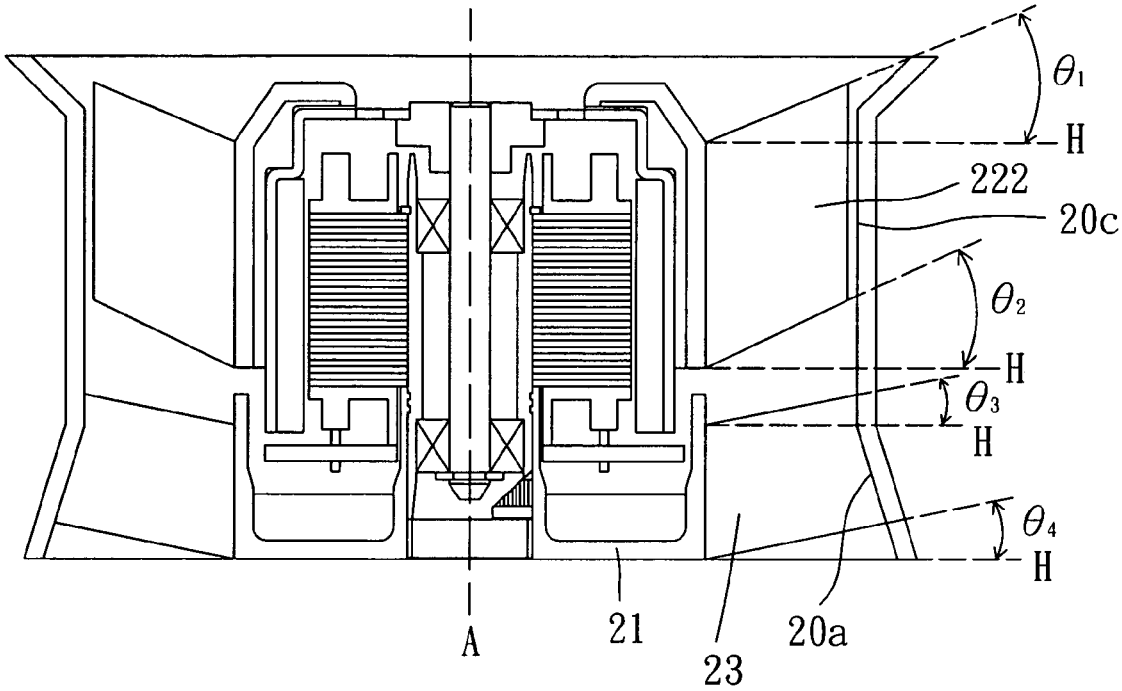
FIG. 5A is a sectional view of the fourth preferred embodiment of the heat-dissipating fan of the present invention.
Figure 5B:
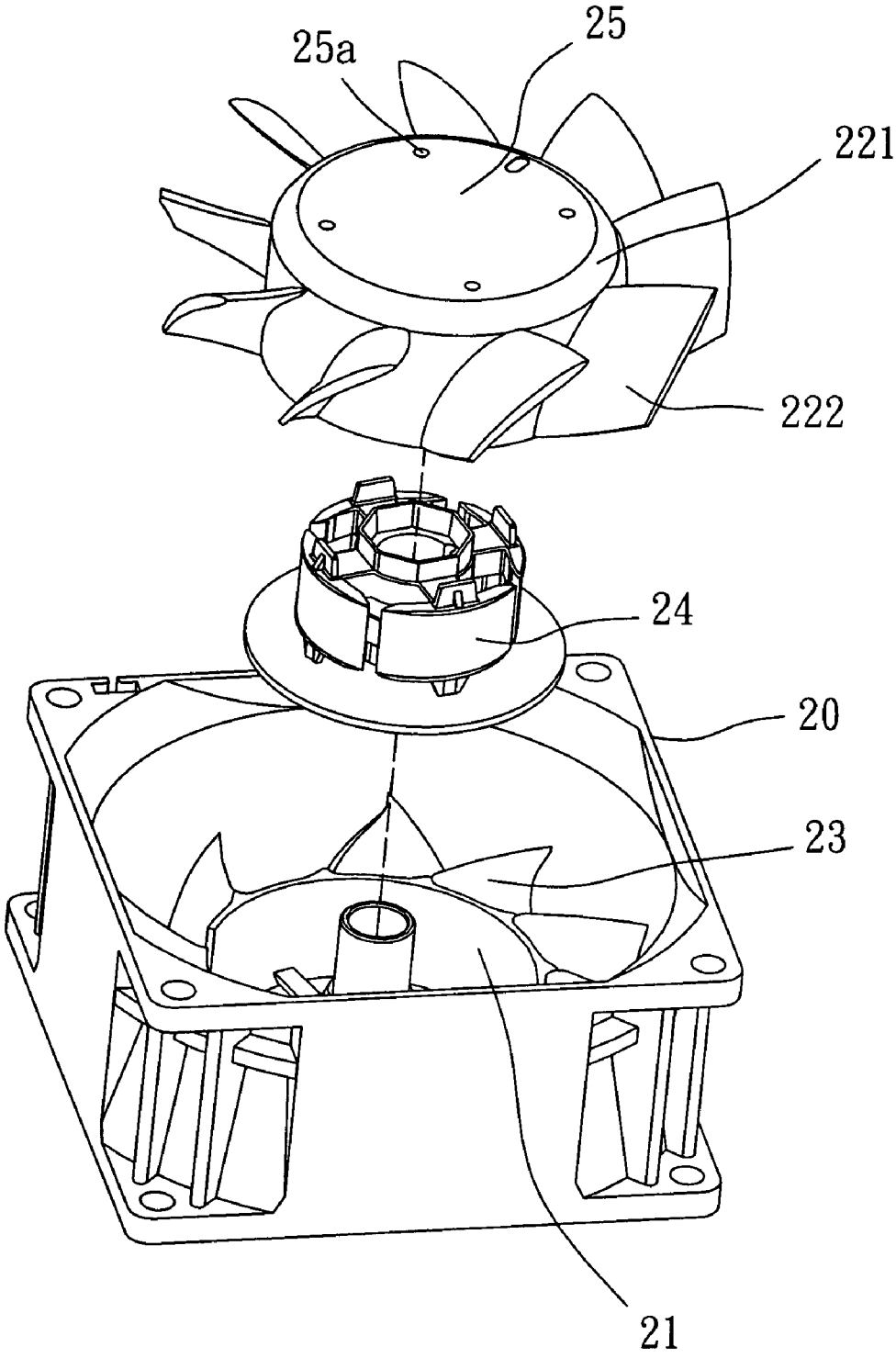
FIG. 5B is an exploded view of the fourth preferred embodiment of the heat-dissipating fan of the present invention.

Please refer to FIGS. 5A and 5B showing the fourth preferred embodiment of the heat-dissipating fan of the present invention. Its structure is substantially similar to that of the third preferred embodiment. In this embodiment, not only are both of the upper and lower edges of the rotor blades 222 extended upwardly, but there is an inclined angle $\theta_3$ between the upper edge of the air-guiding member 23 and the horizontal line H and there is also an inclined angle $\theta_4$ between the lower edge of the air-guiding member 23 and the horizontal line H. The inclined angle $\theta_3$ and 74 $_4$ are preferably ranged from 3° to 45°. The inclined angle $\theta_3$ can be greater than, equal to, or smaller than the inclined angle $\theta_4$. Alternatively, the inclined angles 74 $_1$, 74 $_2$, 74 $_3$ and 74 $_4$ are unequal. Such a design can separate the arriving time of the airflow contacting the air-guiding member 23, thereby eliminating the noise caused by the air turbulence and improving the sound quality. Certainly, users can optionally select one of the upper and lower edges of the air-guiding member 23 as an upward design according to the actual application.

Moreover, one end of the air-guiding member 23 is fixed onto the base 21 and the other end of the air-guiding member 23 is fixed onto the inner wall of the cylindrical part 20*c* of the housing 20. Alternatively, as shown in FIGS. 5A and 5B, one end of the air-guiding member 23 is fixed onto the base 21 and the other end of the air-guiding member 23 is simultaneously connected to the inner wall of the cylindrical part 20*c* of the housing 20 and the inner wall of the outwardly expanding part 20*a*.

The air-guiding member can have a stick, curved, trapezoid or wing-like cross-section shape and the rotor blades have a curved or wing-like cross-section with an inclined angle, preferably ranging from 15° to 60° relative to the axis of the fan, like that shown in FIG. 5B. The air-guiding member can be composed of a plurality of ribs or stationary blades. The number of rotor blades of the impeller is greater than that of ribs or stationary blades.

Figure 6:
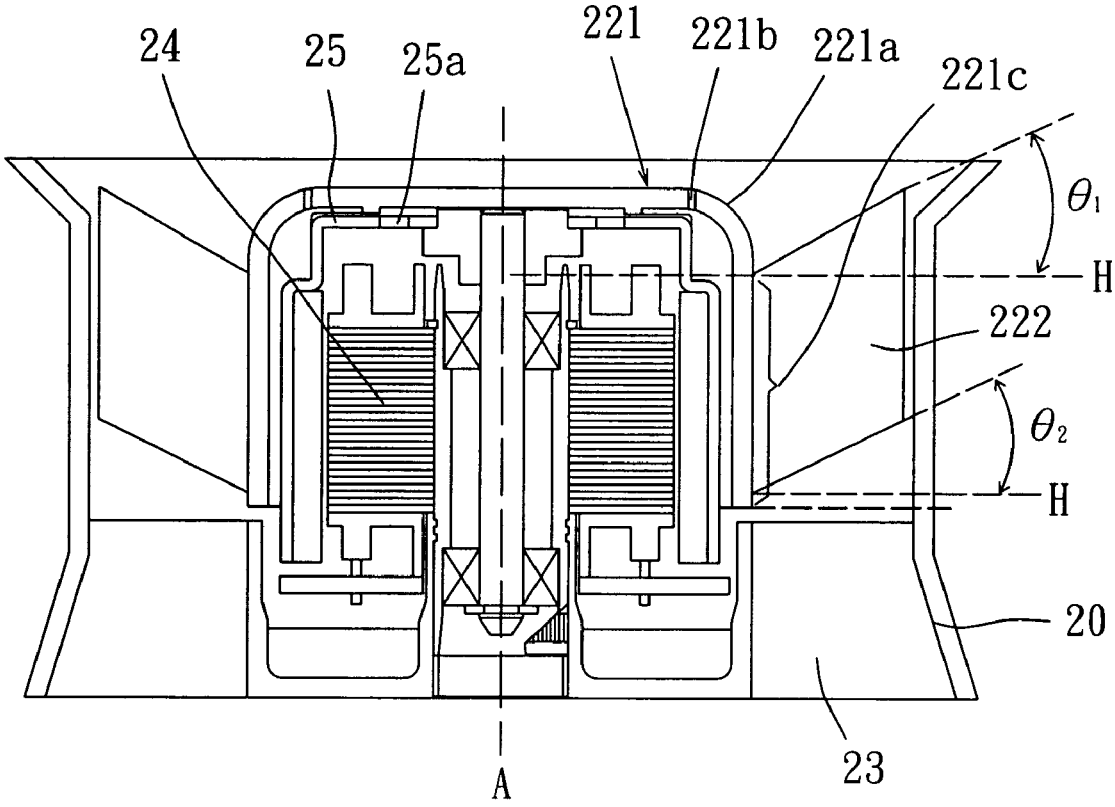
FIG. 6 is a sectional view of the fifth preferred embodiment of the heat-dissipating fan of the present invention.

In addition, please refer to FIG. 6 showing the fifth preferred embodiment of the heat-dissipating fan of the present invention. Its structure is substantially similar to that of the third preferred embodiment of FIG. 4. Their differences are that the metallic shell 25 is telescoped to the hub 221 and completely disposed inside the hub instead of being exposed outside, and the hub 221 includes three portions—the top portion has a plurality of through holes 221*b* for dissipating the heat, generated from the internal components while operating and passing through the openings 25*a* formed on the metallic shell, to outside; the arc structure 221*a* (that is so-called R angle structure) is formed on the periphery of the top portion; and the vertical portion 221*c* is connected with the rotor blades 222 of the impeller, in which the upper inner edge of the rotor blade is positioned on the interface between the vertical portion 221*c* and the arc structure 221*a* for eliminating the noise generation, and the lower inner edge of each blade is slightly higher than the bottom end of the vertical portion 221*c* for reducing the occurrence of deckle edge. In addition, the inclined angle $\theta_1$ of the upper edge of the blade 222 can be unequal to the inclined angle $\theta_2$ of the lower edge of the blade 222.

Figure 1:
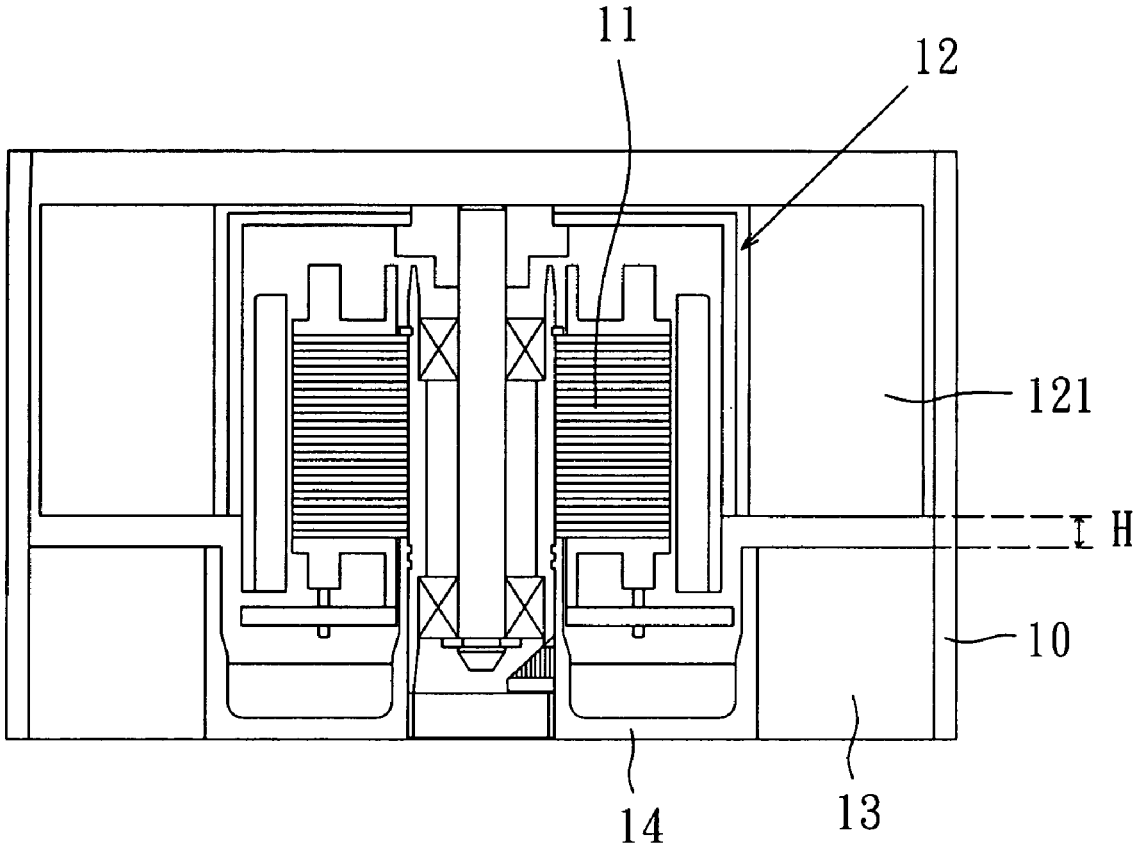
Fig. 1(Prior Art)
FIG. 1 is a sectional view of a conventional axial-flow fan.
Figure 7:
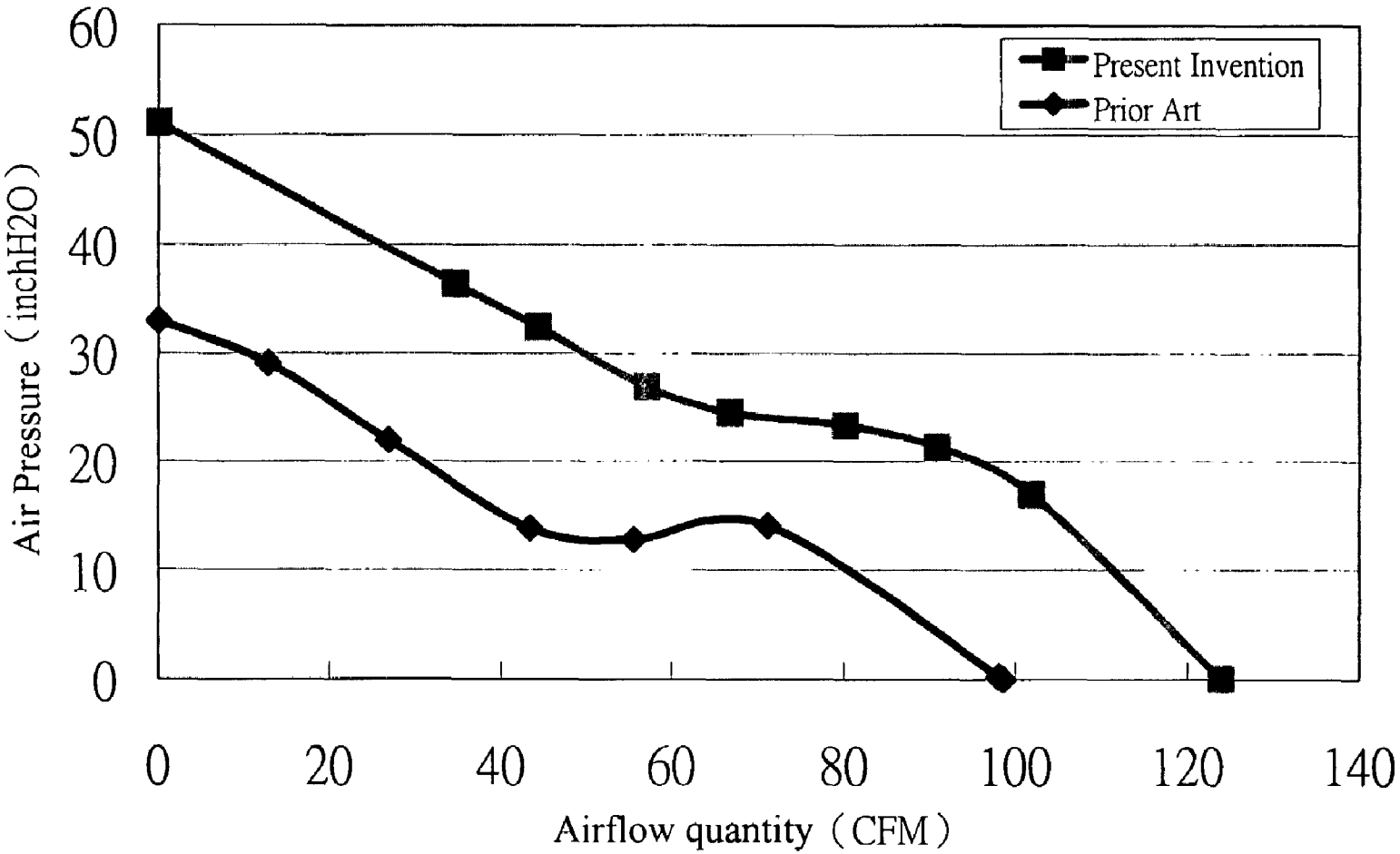
FIG. 7 shows the performance comparison of the air pressure and the airflow quantity between the conventional axial-flow fan and the present invention.

Finally, please refer to FIG. 7 showing the performance comparison of the air pressure and the airflow quantity between the conventional axial-flow fan of FIG. 1 and the present invention. From this figure, it is clearly indicated that not only can the upward-design rotor blades effectively increase the air pressure and the airflow quantity but greatly reduce the noise of air turbulence. For example, at the same rotation speed of 7500 rpm, the heat-dissipating fan with the upward-design rotor blades can decrease at least 5 dBA in comparison with the prior art.

In conclusion, the present invention provides a heat-dissipating fan and its housing with upward rotor blades having linear and inclined edges near the air inlet or outlet, which can greatly reduce the noise of air turbulence and increase the air pressure and quantity so as to enhance its whole heat dissipation efficiency and reduce the load of the rotor blades.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A heat-dissipating fan comprising:

a housing;

an impeller disposed inside the housing, the impeller having a hub and a plurality of rotor blades arranged around the hub;

a base disposed inside the housing for supporting the impeller; and an air-guiding member disposed between the housing and the base, wherein at least one rotor blade has a first edge with a first inclined angle relative to a line perpendicular to an axis of the heat-dissipating fan, and the air-guiding member has an edge which faces an air inlet or outlet side of the housing, with an inclined angle relative to the line.

2. The heat-dissipating fan according to claim 1 wherein the first inclined angle is ranged from 3° to 45°.

3. The heat-dissipating fan according to claim 1 wherein the first edge of the rotor blade is located near an air inlet side of the heat-dissipating fan.

4. The heat-dissipating fan according to claim 1 wherein the rotor blade has a second edge located opposite to the first edge and having a second inclined angle relative to the line.

5. The heat-dissipating fan according to claim 4 wherein the second edge is located near an air outlet side of the heat-dissipating fan.

6. The heat-dissipating fan according to claim 4 wherein the second inclined angle is ranged from 3° to 45°.

7. The heat-dissipating fan according to claim 4 wherein the first inclined angle is relatively greater than or less than the second inclined angle.

8. The heat-dissipating fan according to claim 4 wherein the first inclined angle is equal to the second inclined angle.

9. The heat-dissipating fan according to claim 1 wherein the inclined angle of the edge of the air-guiding member is ranged from 3° to 45°.

10. The heat-dissipating fan according to claim 1 wherein the edge of the air-guiding member is located on a windward side of the heat-dissipating fan.

11. The heat-dissipating fan according to claim 1 wherein the air-guiding member has another edge opposite to the edge facing the blades with a fourth inclined angle relative to the line.

12. The heat-dissipating fan according to claim 11 wherein the inclined angle of the edge of the air-guiding member is relatively greater than or less than the fourth inclined angle.

13. The heat-dissipating fan according to claim 11 wherein the inclined angle of the edge of the air-guiding member is equal to the fourth inclined angle.

14. The heat-dissipating fan according to claim 13 wherein the fourth inclined angle is ranged from 3° to 45°.

15. The heat-dissipating fan according to claim 1 wherein the air-guiding member is positioned on an air inlet or an air outlet of the heat-dissipating fan.

16. The heat-dissipating fan according to claim 1 wherein the air-guiding member has one end connected to the base and the other end free extending toward a direction of an inner wall of the housing.

17. The heat-dissipating fan according to claim 1 wherein the air-guiding member has one end connected to an inner wall of the housing and the other end free extending toward a direction of the base.

18. The hear-dissipating fan according to claim 1 wherein the air-guiding member is composed of a plurality of ribs or stationary blades, some of which respectively have one end connected to the base and the other end free extending toward a direction of an inner wall of the housing, and others of which respectively have one end connected to an inner wall of the housing and the other end free extending toward a direction of the base.

19. The heat-dissipating fan according to claim 1 wherein the air-guiding member has a gradually increasing or decreasing cross-section area from the base toward the housing.

20. The heat-dissipating fan according to claim 1 wherein the air-guiding member has a central part with a thickness relatively greater or smaller than those of two opposite ends thereof.

21. The heat-dissipating fan according to claim 1 wherein the air-guiding member is composed of a plurality of ribs or stationary blades, the number of which is unequal to that of the rotor blades.

22. The heat-dissipating fan according to claim 1 wherein the air-guiding member has a stick, curved, trapezoid, or wing-like cross-section shape.

23. The heat-dissipating fan according to claim 1 wherein the housing includes a cylindrical part and the air-guiding member has one end connected to the base and the other end connected to an inner wall of the cylindrical part.

24. The heat-dissipating fan according to claim 1 wherein the housing has an outwardly expanding part located on an air inlet side or an air outlet side of the heat-dissipating fan for increasing an air intake or discharge.

25. The heat-dissipating fan according to claim 24 wherein the housing includes a cylindrical part and the air-guiding member has one end connected to the base and the other end connected to inner walls of the cylindrical part and the outwardly expanding part.

26. The heat-dissipating fan according to claim 1 wherein the base, the air-guiding member and the housing are integrally formed as a monolith piece by injection molding.

27. The heat-dissipating fan according to claim 1 wherein the rotor blades respectively have a curved or wing-like cross-section with an inclined angle ranging from 15° to 60° relative to the axis of the heat-dissipating fan.

28. The heat-dissipating fan according to claim 1 further comprising a metallic shell telescoped inside the hub and having a plurality of openings.

29. The heat-dissipating fan according to claim 28 wherein the metallic shell has a stepped structure formed on a periphery of a top portion of the metallic shelf.

30. The heat-dissipating fan according to claim 1 wherein the hub has a plurality of through holes formed on a top portion thereof.

31. The heat-dissipating fan according to claim 1 further comprising a driving device mounted inside the hub for driving the impeller.

32. The heat-dissipating fan according to claim 1 wherein the hub has an inclined or arc structure formed on a periphery of a top portion thereof, and a vertical portion.

33. The heat-dissipating fan according to claim 32 wherein the rotor blades of the impeller respectively have an upper inner edge positioned at an interface between the inclined or arc structure and the vertical portion.

34. The heat-dissipating fan according to claim 32 wherein the rotor blades of the impeller respectively have a lower inner edge relatively higher than a bottom end of the vertical portion.

35. A heat-dissipating fan comprising:

a housing having an outwardly expanding part located on an air inlet side or an air outlet side of the heat-dissipating fan for increasing an air intake or discharge;

an impeller having a hub and a plurality of rotor blades arranged around the hub; and a base disposed inside the housing for supporting the impeller, wherein at least one rotor blade has a first edge facing the air inlet or outlet side with a first inclined angle relative to a line perpendicular to an axis of the heat-dissipating fan.

36. The heat-dissipating fan according to claim 35 further comprising an air-guiding member disposed between the housing and the base, wherein the housing includes a cylindrical part and the air-guiding member has one end connected to the base and the other end connected to inner walls of the cylindrical part and the outwardly expanding part.

* * * * *